US012173970B2

(12) United States Patent
Eguchi et al.

(10) Patent No.: US 12,173,970 B2
(45) Date of Patent: Dec. 24, 2024

(54) HEAT EXCHANGER CORE WITH IMPROVED HEAT EXCHANGE EFFICIENCY

(71) Applicant: MITSUBISHI HEAVY INDUSTRIES, LTD., Tokyo (JP)

(72) Inventors: Shunsaku Eguchi, Tokyo (JP); Nobuhide Hara, Tokyo (JP); Hiroyuki Nakaharai, Tokyo (JP); Yoichi Uefuji, Tokyo (JP); Masaya Hatanaka, Tokyo (JP); Takuo Oda, Tokyo (JP); Koichi Tanimoto, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 242 days.

(21) Appl. No.: 17/801,402

(22) PCT Filed: Feb. 24, 2021

(86) PCT No.: PCT/JP2021/006736
§ 371 (c)(1),
(2) Date: Aug. 22, 2022

(87) PCT Pub. No.: WO2021/172310
PCT Pub. Date: Sep. 2, 2021

(65) Prior Publication Data

US 2023/0087617 A1 Mar. 23, 2023

(30) Foreign Application Priority Data

Feb. 27, 2020 (JP) ..... 2020-031240

(51) Int. Cl.
*F28D 7/00* (2006.01)
*F28F 7/02* (2006.01)

(52) U.S. Cl.
CPC ..... *F28D 7/0008* (2013.01); *F28F 7/02* (2013.01); *F28F 2225/04* (2013.01); *F28F 2270/02* (2013.01)

(58) Field of Classification Search
CPC ..... F28D 7/0008; F28F 7/02; F28F 2225/04; F28F 2270/02; F28F 2270/00
(Continued)

(56) References Cited

U.S. PATENT DOCUMENTS 6,119,767 A * 9/2000 Kadota ..... F28F 1/126 165/104.33
2008/0311839 A1* 12/2008 Liu ..... F28D 21/0014 454/239

(Continued)

FOREIGN PATENT DOCUMENTS

DE 4303276 A1 * 8/1994 ..... F28D 9/0025
DE 20 2007 008 61 U1 9/2007

(Continued)

OTHER PUBLICATIONS

Japanese Office Action for Japanese Application No. 2020-031240, dated Nov. 14, 2023, with English translation.

(Continued)

*Primary Examiner* — Steve S Tanenbaum
(74) *Attorney, Agent, or Firm* — Birch, Stewart, Kolasch & Birch, LLP

(57) ABSTRACT

A heat exchanger core includes a core formed such that a pair of adjacent passages are folded on top of one another while being adjacent. At least one passage of the pair of adjacent passages has a pair of adjacent passage portions between which the other passage is not interposed in a direction in which the passages lie on top of one another. The core has a heat insulation layer between the pair of passage portions.

5 Claims, 9 Drawing Sheets

(58) Field of Classification Search
USPC ..... 165/135
See application file for complete search history.

(56) References Cited

U.S. PATENT DOCUMENTS

| | | | |
|---|---|---|---|
| 2018/0142967 | A1 | 5/2018 | Kawaguchi et al. |
| 2021/0095930 | A1 | 4/2021 | Inagaki et al. |
| 2022/0290924 | A1 | 9/2022 | Eguchi et al. |

FOREIGN PATENT DOCUMENTS

| | | | |
|---|---|---|---|
| EP | 1 054 225 | A1 | 11/2000 |
| JP | 60-105967 | U | 7/1985 |
| JP | 2004-44896 | A | 2/2004 |
| JP | 2006-322644 | A | 11/2006 |
| JP | 3936088 | B2 | 6/2007 |
| JP | 2008-82698 | A | 4/2008 |
| JP | 2010-60215 | A | 3/2010 |
| JP | 2014-35169 | A | 2/2014 |
| JP | 2018-80900 | A | 5/2018 |
| JP | 2019-207076 | A | 12/2019 |
| JP | 2021-38894 | A | 3/2021 |
| KR | 20-1985-0003461 | U | 6/1985 |
| KR | 10-0857976 | B1 | 9/2008 |

OTHER PUBLICATIONS

International Preliminary Report on Patentability and Written Opinion of the International Searching Authority for International Application No. PCT/JP2021/006736, dated Sep. 9, 2022, with a English translation.

International Search Report for International Application No. PCT/JP2021/006736, dated Apr. 6, 2021.

* cited by examiner

HEAT EXCHANGER CORE WITH IMPROVED HEAT EXCHANGE EFFICIENCY

TECHNICAL FIELD

The present disclosure relates to a heat exchanger core.

The present application claims priority based on Japanese Patent Application No. 2020-031240 filed Feb. 27, 2020, the entire content of which is incorporated herein by reference.

BACKGROUND ART

A plate-type heat exchanger core is known in which, in a plate laminate comprising many plates, interplate first fluid paths for passing a first fluid between the plates and interplate second fluid paths for passing a second fluid between the plates are alternately arranged in the plate laminating direction (see Patent Document 1, for example).

CITATION LIST

Patent Literature

Patent Document 1: JP3936088B

SUMMARY

Problems to be Solved

There is a need for a heat exchanger core with higher heat exchange efficiency than the plate-type heat exchanger core disclosed in Patent Document 1.

In view of the above, an object of at least one embodiment of the present disclosure is to provide a heat exchanger core that can improve the heat exchange efficiency.

Solution to the Problems

In order to achieve the above object, a heat exchanger core according to the present disclosure includes a core formed such that a pair of adjacent passages are folded on top of one another while being adjacent. At least one passage of the pair of adjacent passages has a pair of adjacent passage portions between which the other passage is not interposed in a direction in which the passages lie on top of one another. The core has a heat insulation layer between the pair of passage portions.

Advantageous Effects

With the heat exchanger core according to the present disclosure, the heat insulation layer disposed between the pair of passage portions reduces heat loss due to heat exchange between a fluid flowing in the upstream portion and a fluid flowing in the downstream portion (between the same fluids) of the pair of passage portions. Thus, it is possible to improve the heat exchange efficiency of the heat exchanger core.

DETAILED DESCRIPTION

A heat exchanger core according to some embodiments will now be described with reference to the accompanying drawings. It is intended, however, that unless particularly identified, dimensions, materials, shapes, relative positions, and the like of components described in the embodiments shall be interpreted as illustrative only and not intended to limit the scope of the present invention. The heat exchanger core is a component used alone or incorporated in a heat exchanger, and heat exchange is performed between a first fluid and a second fluid supplied to the heat exchanger core.

Figure 1:
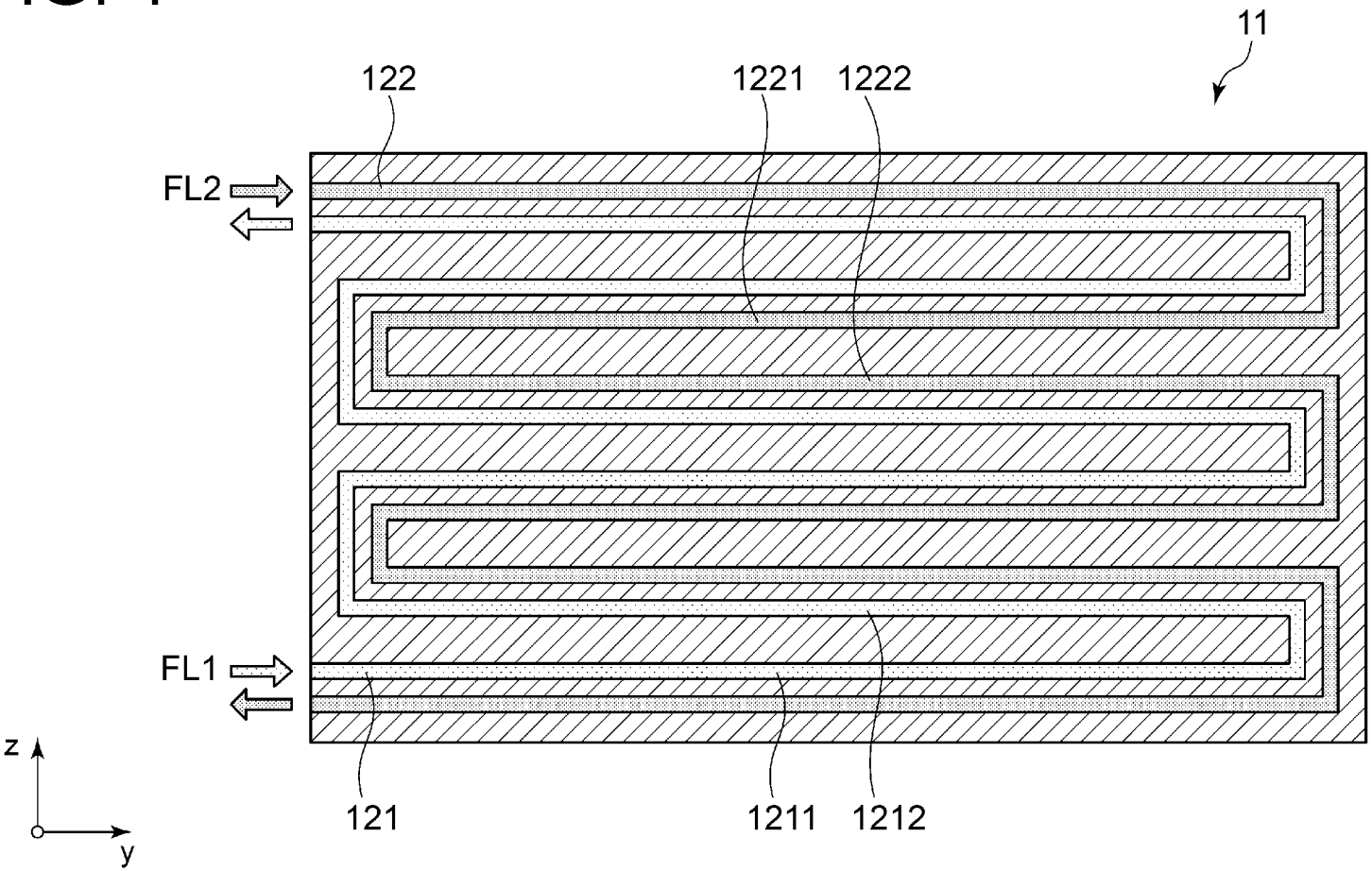
FIG. 1 is a cross-sectional view schematically showing a configuration of a heat exchanger core obtained by AM technology.

FIG. 1 is a cross-sectional view schematically showing a configuration of a heat exchanger core obtained by AM technology.

By applying AM (Additive Manufacturing) technology, which has a high degree of freedom in shape, to produce the heat exchanger core, it is possible to form passages and structures that could not be achieved in the past due to restrictions on construction methods, and thus it is possible to obtain a highly efficient and compact heat exchanger core. For example, as shown in FIG. 1, it is possible to obtain a heat exchanger core 11 with a first passage 121 for passing a first fluid FL1 and a second passage 122 for passing a second fluid FL2 adjacent to each other with a gap in which the first passage 121 and the second passage 122 are folded on top of one another while the first passage 121 and the second passage 122 are adjacent to each other with a gap. In this heat exchanger core 11, the first passage 121 and the second passage 122 each have a pair of adjacent passage portions 1211, 1212 (1221, 1222) between which the other passage 122 (121) is not interposed in the direction in which the passages lie on top of one another. The pair of passage portions 1211, 1212 (1221, 1222) are different portions (upstream portion and downstream portion) of the same passage 121 (122) (e.g., first passage), and a fluid flowing in the upstream portion 1211 (1221) and a fluid flowing in the downstream portion 1212 (1222) are the same. Since the pair of passage portions 1211, 1212 (1221, 1222) (upstream portion and downstream portion of the same passage) are adjacent to each other without the other passage 122 (121)

interposed therebetween, heat loss occurs due to heat exchange between the fluid flowing in the upstream portion 1211 (1221) and the fluid flowing in the downstream portion 1212 (1222) (between the same fluids). This heat loss causes a decrease in heat exchange efficiency of the heat exchanger core 11.

Then, the purpose of the heat exchanger core according to the following embodiments is to improve the heat exchange efficiency.

Figure 2:
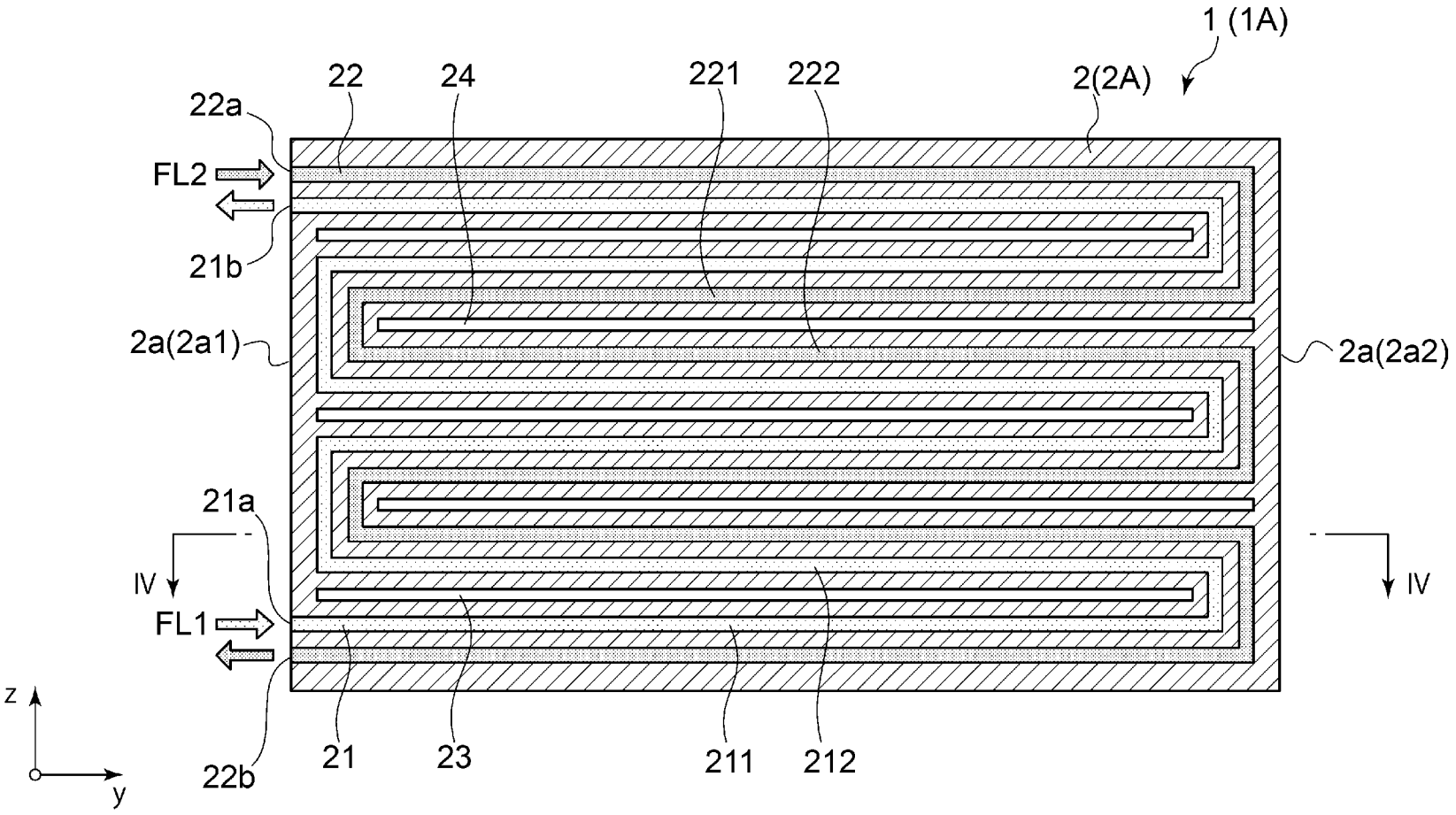
FIG. 2 is a vertical cross-sectional view schematically showing a configuration of a heat exchanger core according to an embodiment.
Figure 3:
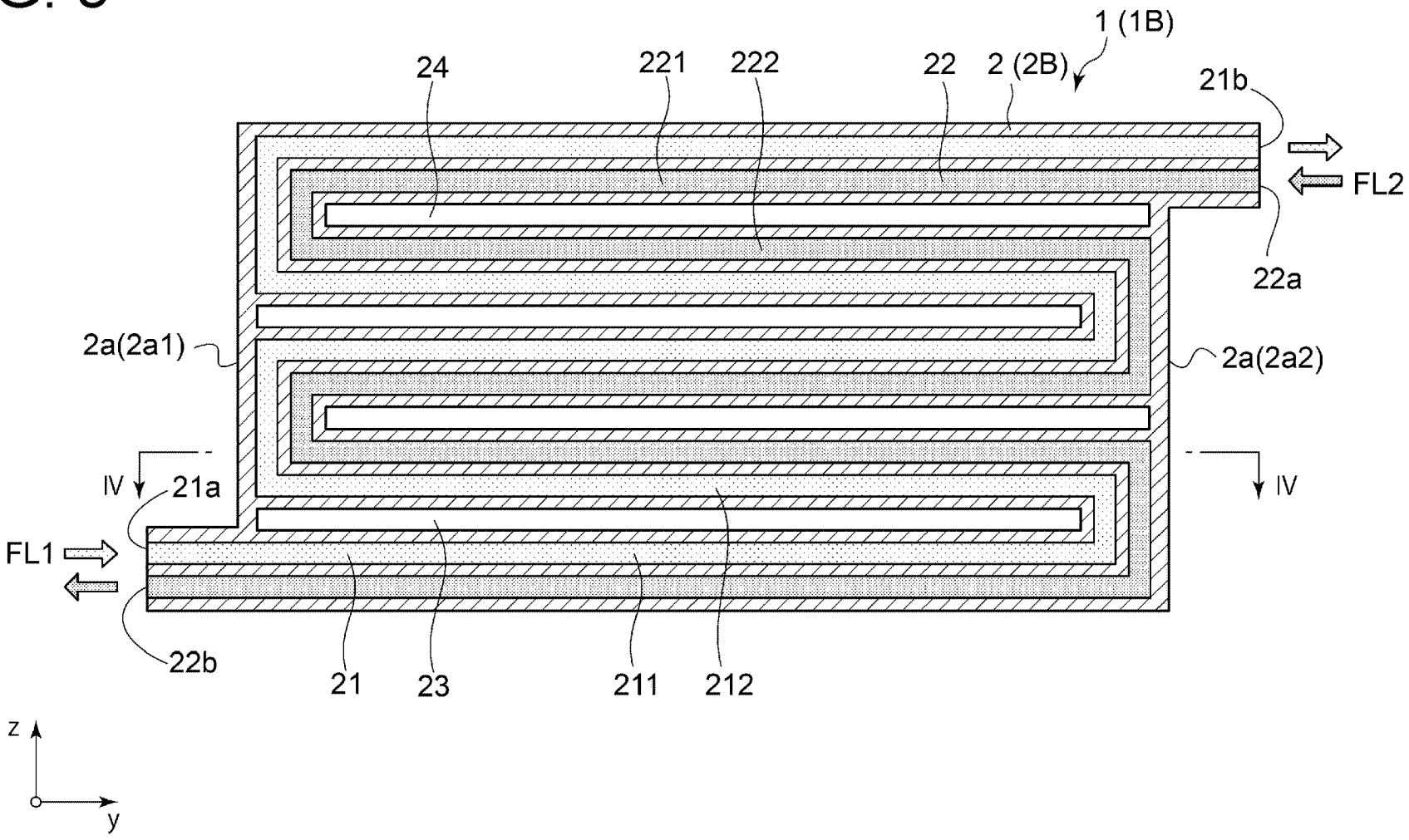
FIG. 3 is a vertical cross-sectional view schematically showing a configuration of a heat exchanger core according to an embodiment.
Figure 4:
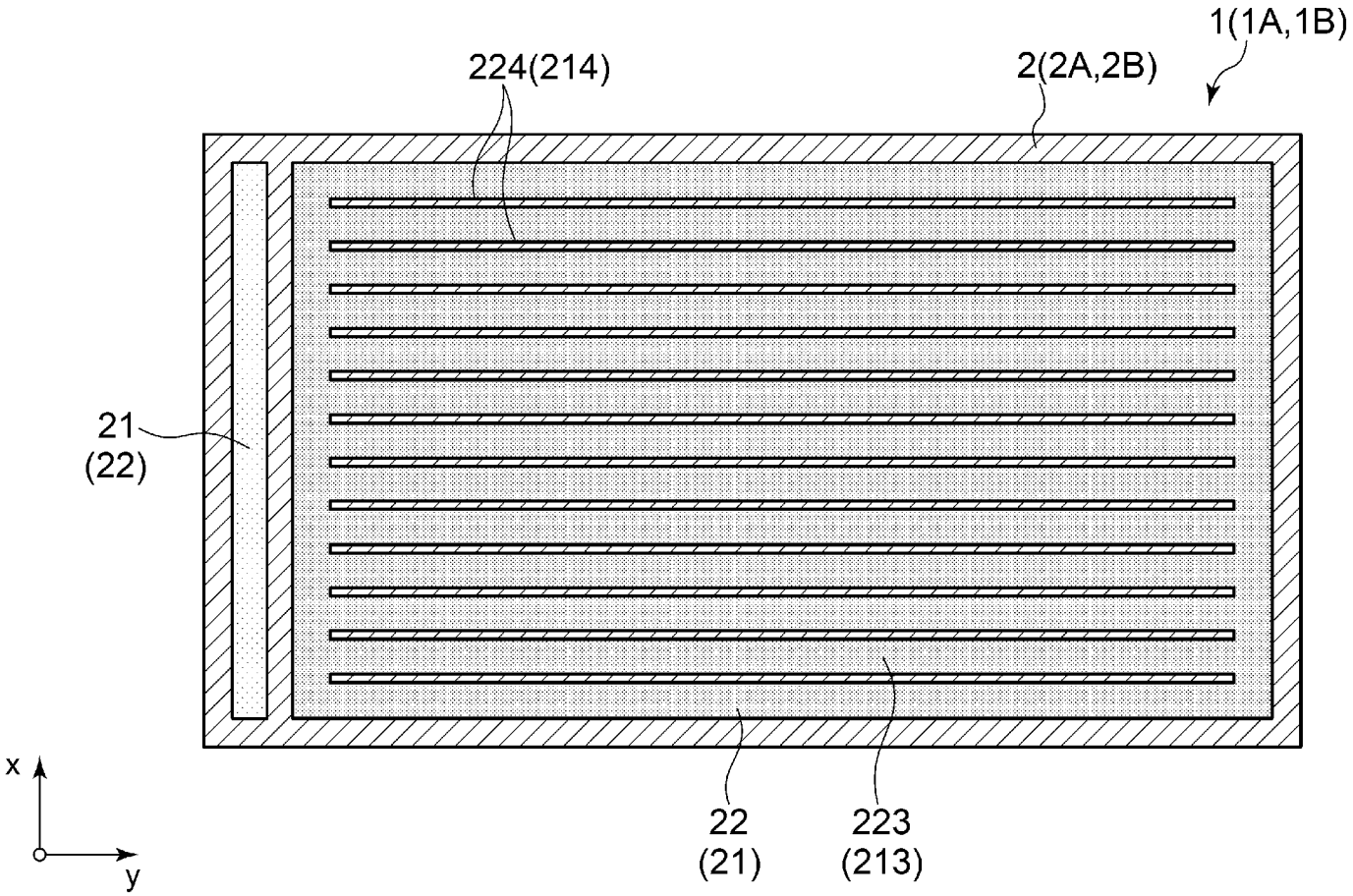
FIG. 4 is a cross-sectional view of the heat exchanger core shown in FIG. 2, taken along line IV-IV.

FIG. 2 is a vertical cross-sectional view schematically showing a configuration of the heat exchanger core 1 according to an embodiment. FIG. 3 is a vertical cross-sectional view schematically showing a configuration of the heat exchanger core 1 according to another embodiment. FIG. 4 is a cross-sectional view of the heat exchanger core 1 shown in FIG. 2, taken along line IV-IV, but the cross-section IV-IV of the heat exchanger core 1 shown in FIG. 2 is shown identically.

As shown in FIGS. 2 to 4, the heat exchanger core 1 according to some embodiments is a heat exchanger core for exchanging heat between the first fluid FL1 and the second fluid FL2. The heat exchanger core 1 includes a core 2. The core 2 has a pair of adjacent passages 21, 22. One of the pair of adjacent passages 21, 22 is a first passage 21, and the other is a second passage 22. The first passage 21 is a passage through which the first fluid FL1 flows, and the second passage 22 is a passage through which the second fluid FL2 flows. The first fluid FL1 and the second fluid FL2 are fluids having different temperatures. For example, the first fluid FL1 is a high temperature fluid, and the second fluid FL2 is a low temperature fluid. The first fluid FL1 and the second fluid FL2 may be either a gas or a liquid. One of the first fluid FL1 or the second fluid FL2 may be a gas while the other may be a liquid.

The first passage 21 and the second passage 22 are adjacent to each other with a gap. The first passage 21 and the second passage 22 are folded on top of one another while being adjacent with a gap. One end and the other end of the first passage 21 open to a side surface 2*a* of the core 2 and serve as an inlet 21*a* and an outlet 21*b* of the first passage 21, respectively. One end of the second passage 22 adjacent to the inlet 21*a* of the first passage 21 servers as an outlet 22*b* of the second passage 22, and the other end of the second passage 22 adjacent to the outlet 21*b* of the first passage 21 serves as an inlet 22*a* of the second passage 22. Thus, the first fluid FL1 flowing through the first passage 21 and the second fluid FL2 flowing through the second passage 22 have a countercurrent relationship so that the first fluid FL1 flowing through the first passage 21 and the second fluid FL2 flowing through the second passage 22 flow in opposite directions and past each other to exchange heat between the first fluid FL1 and the second fluid FL2.

At least one passage 21 (22) of the first passage 21 or the second passage 22 has a pair of adjacent passage portions 211, 212 (221, 222) between which the other passage 22 (21) is not interposed in the direction in which the passage 21 (22) lies on top of one another. Further, the core 2 is provided with a heat insulation layer 23 (24) between the pair of passage portions 211, 212 (221, 222).

Such a core 2 in which the first passage 21 and the second passage 22 are adjacent to each other with a gap, the first passage 21 and the second passage 22 are folded on top of one another while being adjacent to each other with a gap, and a heat insulation layer is disposed between the pair of adjacent passage portions 211, 212 (221, 222) between which the other passage 22 (21) is not interposed can be achieved by AM technology.

In the examples shown in FIGS. 2 to 4, the core 2 is formed in a rectangular cuboid shape in which the lateral direction (y direction in FIGS. 2 and 3) is long and the height direction (z direction in FIGS. 2 and 3) and the depth direction (x direction in FIG. 4) are short. Further, the first passage 21 and the second passage 22 are formed such that the first passage 21 and the second passage 22 that are wide in the depth direction (x direction in FIG. 4) are adjacent to each other with a gap, and the first passage 21 and the second passage 22 are folded on top of one another while being adjacent with a gap.

In the examples shown in FIGS. 2 to 4, both the first passage 21 and the second passage 22 have pairs of adjacent passage portions 211, 212, 221, 222 between which the other passages 22, 21 are not interposed in the direction (height direction, z direction in FIGS. 2 and 3) in which the passages 21, 22 lie on top of one another. Specifically, the first passage 21 has a pair of adjacent passage portions 211, 212 between which the other passage 22 is not interposed in the direction (height direction, z direction in FIGS. 2 and 3) in which the passage 21 lies on top of one another, and the second passage 22 has a pair of adjacent passage portions 221, 222 between which the other passage 21 is not interposed in the direction in which the passage 22 lies on top of one another. Further, the core 2 is provided with a heat insulation layer 23, 24 between the pair of adjacent passage portions 211, 212, 221, 222 of each of the first passage 21 and the second passage 22 between which the other passage 22, 21 is not interposed.

In the heat exchanger core 1 according to the above-described embodiments, since the first fluid FL1 is supplied through the inlet 21*a* of the first passage 21 while the second fluid FL2 is supplied through the inlet 22*a* of the second passage 22, the first fluid FL1 and the second fluid FL2 have a countercurrent relationship so that the first fluid FL1 and the second fluid FL2 flow in opposite directions and past each other to exchange heat between the first fluid FL1 and the second fluid FL2.

With the heat exchanger core 1 according to the above-described embodiments, the heat insulation layer 23, 24 disposed between the pair of passage portions 211, 212, 221, 222 reduces heat loss due to heat exchange between a fluid flowing in the upstream portion 211, 221 and a fluid flowing in the downstream portion 212, 222 (between the same fluids) of the pair of passage portions 211, 212, 221, 222. Thus, it is possible to improve the heat exchange efficiency of the heat exchanger core 1.

As shown in FIG. 2, in the heat exchanger core 1A according to one embodiment, the inlet 21*a* and the outlet 21*b* of the first passage 21 and the inlet 22*a* and the outlet 22*b* of the second passage 22 are disposed on the same side surface 2*al* of the core 2A. As shown in FIG. 3, in the heat exchanger core 1B according to the other embodiment, the inlet 21*a* and the outlet 21*b* of the first passage 21 and the inlet 22*a* and the outlet 22*b* of the second passage 22 are disposed on the opposite side surfaces 2*a*2 of the core 2B. Thus, since in the heat exchanger core 1A according to one embodiment, the inlet 21*a* and the outlet 21*b* of the first passage 21 and the inlet 22*a* and the outlet 22*b* of the second passage 22 are disposed on the same side surface 2*al* of the core 2A, while in the heat exchanger core 1B according to the other embodiment, the inlet 21*a* and the outlet 21*b* of the first passage 21 and the inlet 22*a* and the outlet 22*b* of the second passage 22 are disposed on the opposite side surfaces 2*a*2 of the core 2B, the heat exchanger core 1A according to one embodiment or the heat exchanger core 1B according to the other embodiment can be selected depending on the conditions such as piping.

Figure 5:
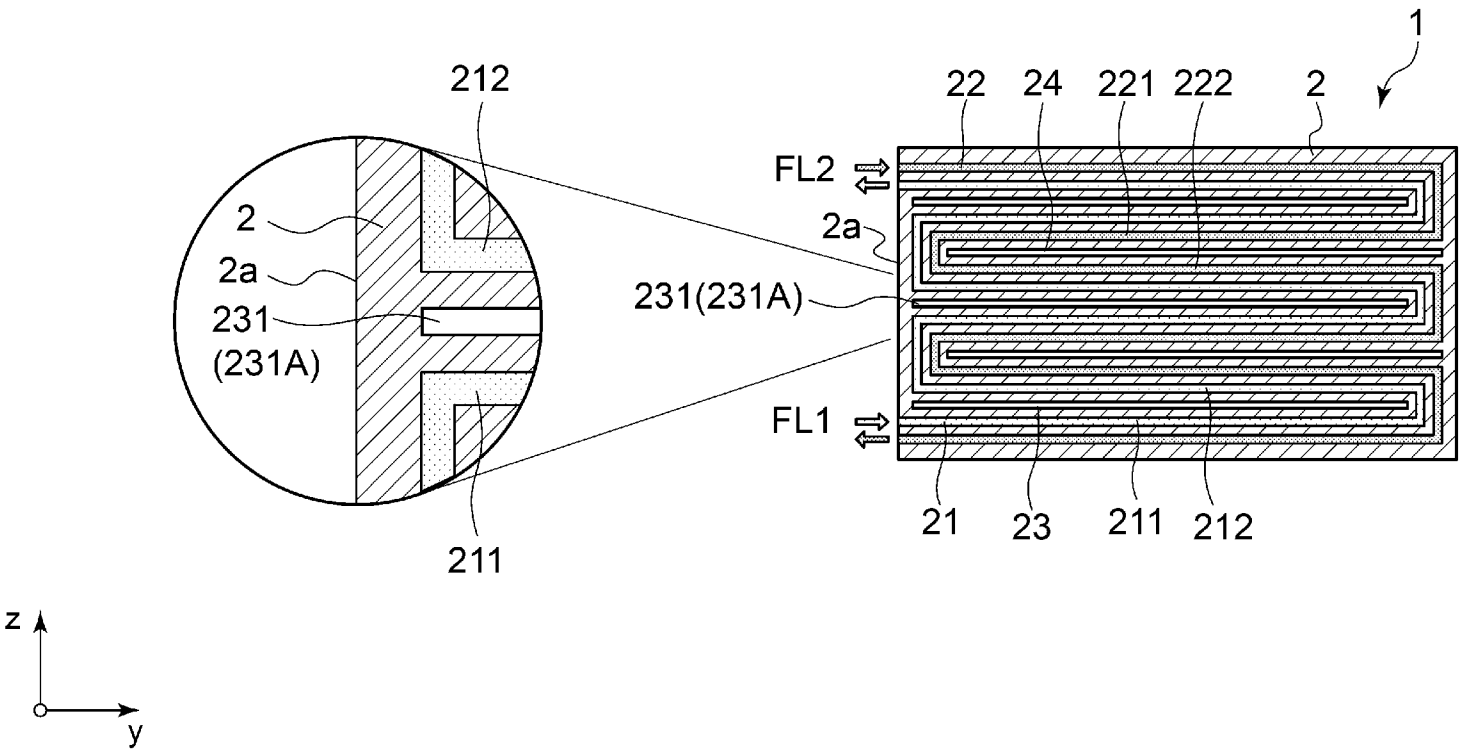
FIG. 5 is a partial enlarged cross-sectional view schematically showing a configuration of a heat insulation layer provided in a core of a heat exchanger core according to an embodiment.
Figure 6:
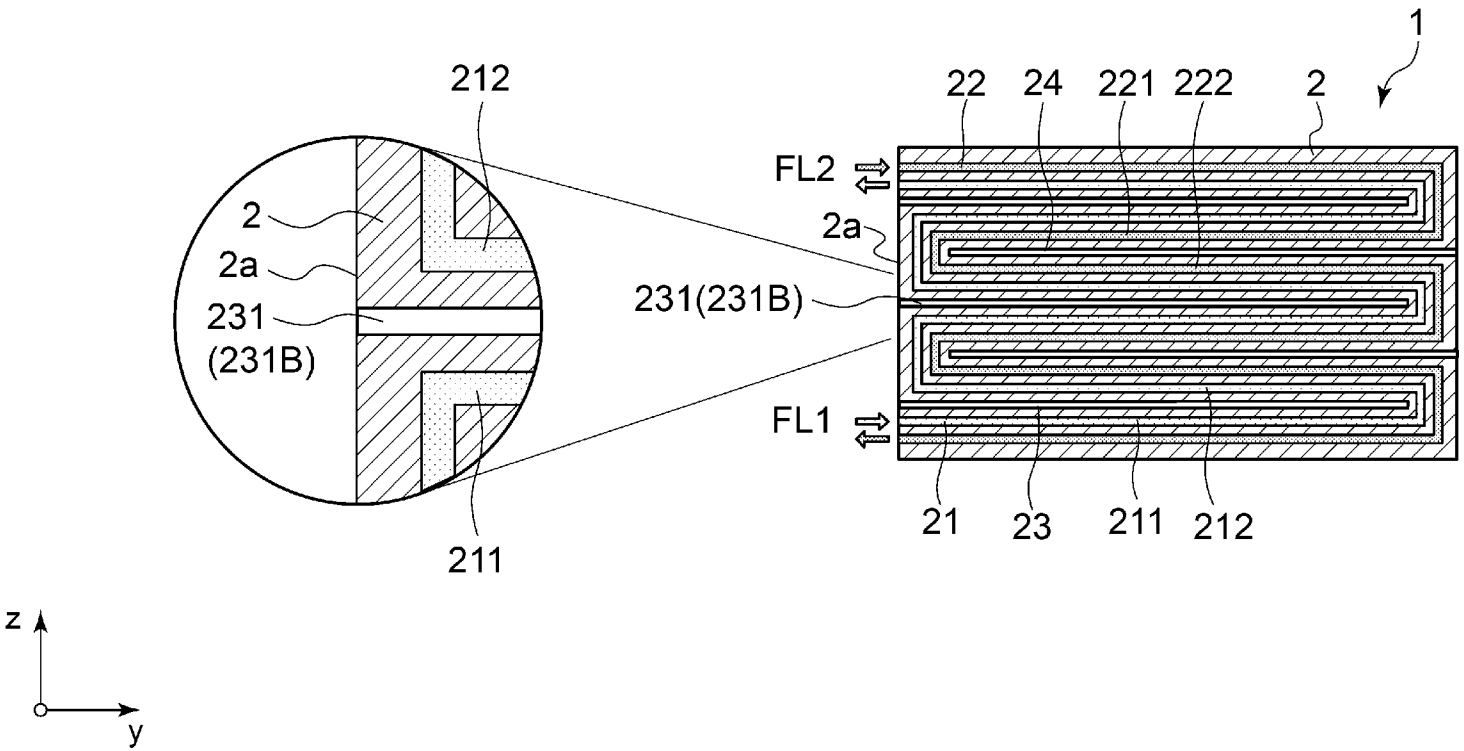
FIG. 6 is a partial enlarged cross-sectional view schematically showing a configuration of a heat insulation layer provided in a core of a heat exchanger core according to an embodiment.

FIG. 5 is a partial enlarged cross-sectional view schematically showing the heat insulation layer 23 provided in the core 2 of the heat exchanger core 1 according to an embodiment. FIG. 6 is a partial enlarged cross-sectional view schematically showing the heat insulation layer 23 provided in the core 2 of the heat exchanger core 1 according to another embodiment.

As shown in FIGS. 5 and 6, in the heat exchanger core 1 according to some embodiments, the heat insulation layer 23 is a void 231. In the example shown in FIG. 5, the void 231A is closed, but as shown in FIG. 6, the void 231B may be at least partially open. In the void 231A, 231B, air is contained, but the closed void 231A may be filled with a gas other than air or may be in a vacuum.

With the heat exchanger core 1 according to the above-described embodiments, the void 231 disposed between the pair of passage portions 211, 212, 221, 222 between which the other passage is not interposed reduces heat loss due to heat exchange between a fluid flowing in the upstream portion 211, 221 and a fluid flowing in the downstream portion 212, 222 (between the same fluids) of the pair of passage portions 211, 212, 221, 222. Thus, it is possible to suppress a decrease in the heat exchange efficiency of the heat exchanger core 1. When air is contained in the void 231, the void 231 is an air layer. In the air layer, heat transfer occurs due to air convection, but heat transfer due to air convection in the air layer is less likely to transfer heat than heat conduction in metal parts, suppressing heat transfer between the fluid flowing in the upstream portion 211, 221 and the fluid flowing in the downstream portion 212, 222 (between the same fluids) of the pair of passage portions 211, 212, 221, 222. Thus, the air layer between the pair of passage portions 211, 212, 221, 222 exhibits a heat insulation effect.

Figure 7:
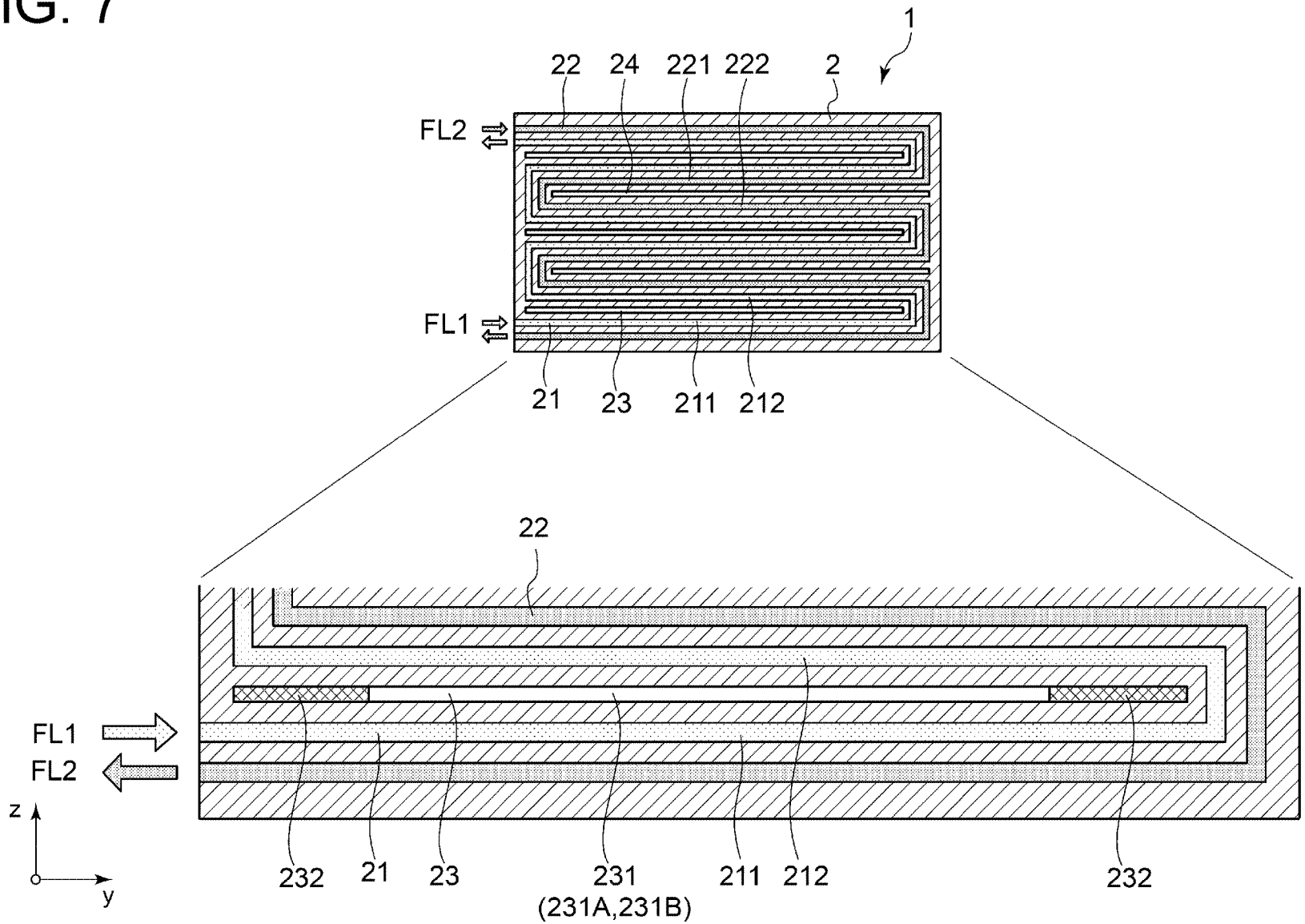
FIG. 7 is a cross-sectional view schematically showing a heat insulation layer of a heat exchanger core according to an embodiment.

FIG. 7 is a cross-sectional view schematically showing the heat insulation layer 23 of the heat exchanger core 1 according to an embodiment.

As shown in FIG. 7, in the heat exchanger core 1 according to an embodiment, the heat insulation layer 23 is a void 231, and a strut portion 232 is provided at least at an end of the void 231 for supporting the void 231. The strut portion 232 may be provided only at the end of the void 231, or may be provided over the entire void 231, or may be provided in the void 231 at predetermined pitch (equal pitch or unequal pitch) as long as it is provided at least at the end of the void 231.

With the heat insulation layer 23 of the heat exchanger core 1 according to the above-described embodiment, since the strut portion 232 supports the void 231 at least at the end portion of the void, it is possible to suppress a decrease in the strength of the core 2 having the void.

Figure 8:
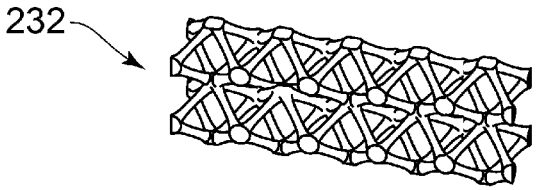
FIG. 8 is a diagram showing a configuration of a strut portion of a heat exchanger core according to an embodiment.

FIG. 8 is a diagram showing a configuration of the strut portion 232 of the heat exchanger core 1 according to an embodiment.

As described above, if the void 231 has the strut portion 232, heat conduction occurs in the strut portion 232, so that the amount of heat transferred is larger than when the void 231 is filled only with air, resulting in a decrease in the heat insulation effect of the void 231.

Then, as shown in FIG. 8, in the heat exchanger core 1 according to an embodiment, the strut portion 232 has a wire mesh-like three-dimensional lattice structure. The wire mesh-like three-dimensional lattice structure is an intersection of three-dimensional lattices and is referred to as a lattice structure.

The wire mesh-like three-dimensional lattice structure may be a periodically repeating three-dimensional lattice or a not-periodically repeating three-dimensional lattice. The wire mesh-like three-dimensional lattice structure may made of the same material as the metal or resin that makes up the core 2, for example, by AM technology.

Further, as described above, the strut portion 232 may be provided only at the end of the void 231, or may be provided over the entire void 231, or may be provided in the void 231 at predetermined pitch as long as it is provided at least at the end of the void 231. That is, the strut portion 232 having a wire mesh-like three-dimensional lattice structure may be provided only at the end of the void 231, or the strut portion 232 having a wire mesh-like three-dimensional lattice structure may be provided over the entire void 231, or the strut portion 232 having a wire mesh-like three-dimensional lattice structure may be provided in the void 231 at predetermined pitch.

When the strut portion 232 having a wire mesh-like three-dimensional lattice structure is provided in the void 231, heat conduction occurs through the wire between the upstream portion 211, 221 and the downstream portion 212, 222 of the pair of adjacent passage portions 211, 212, 221, 222 between which the other passage is not interposed, but by reducing the cross-sectional area and increasing the length of the wire that constitutes the wire mesh-like three-dimensional lattice structure, it is possible to reduce the amount of heat conducted between the upstream portion 211, 221 and the downstream portion 212, 222 of the pair of adjacent passage portions 211, 212, 221, 222 between which the other passage is not interposed.

Further, although air convection occurs in the void 231 due to a temperature difference between the upstream portion 211, 221 and the downstream portion 212, 222 of the pair of adjacent passage portions 211, 212, 221, 222 between which the other passage is not interposed, the wire mesh-like three-dimensional lattice structure is expected to have the effect of suppressing convection.

With the strut portion 232 of the heat exchanger core 1 according to the above-described embodiment, it is possible to suppress a decrease in the strength of the core 2A, 2B while suppressing heat conduction by the strut portion 232.

As shown in FIG. 4, the heat exchanger core 1 according to some embodiments has a partition wall 214, 224 dividing at least one of the first passage 21 or the second passage 22 into a plurality of divided passages 213, 223 (multi-holes). For example, the heat exchanger core 1 may have a partition wall 214, 224 for both the first passage 21 and the second passage 22 for dividing them into a plurality of divided passages 213, 223. For example, the number of partition walls 214, 224 may be the same between the first passage 21 and the second passage 22, and the number of divided passages 213 provided in the first passage 21 may be the same as the number of divided passages 223 provided in the second passage 22.

With the heat exchanger core 1 according to the above-described embodiments, since at least one of the first passage 21 or the second passage 22 is divided into a plurality of divided passages 213, 223, the diameter of each passage is reduced, so that the heat transfer rate is increased, and the heat exchange efficiency is improved. Further, the slower flow velocity of the fluid flowing through the passage (first passage 21 or second passage 22) divided into the divided passages 213, 223 improves the heat exchange performance.

Figure 9A:
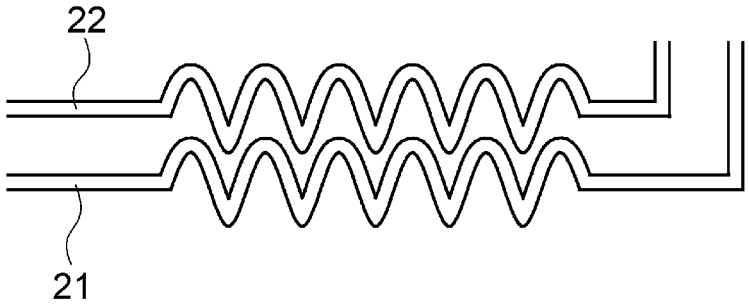
FIG. 9A is a diagram showing a first passage and a second passage according to an embodiment.
Figure 9B:
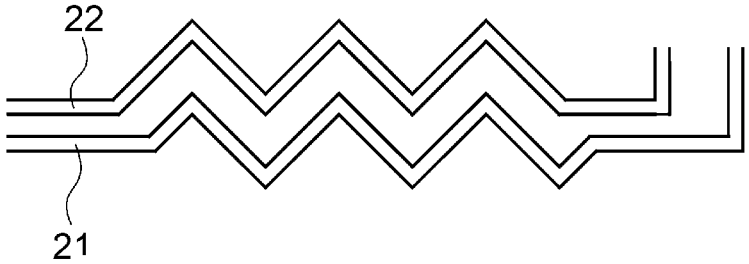
FIG. 9B is a diagram showing a first passage and a second passage according to another embodiment.
Figure 9C:
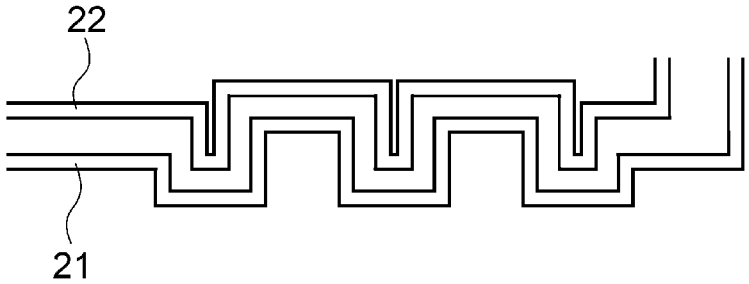
FIG. 9C is a diagram showing a first passage and a second passage according to another embodiment.

As shown in FIG. 9, in the heat exchanger core 1 according to some embodiments, at least one of overlying portions of the pair of passages partially has a bent portion. The overlying portions of the pair of passages 21, 22 are portions other than the folded portions where the pair of passages 21 and 22 are folded back. In the example shown in FIG. 9, both the overlying portions of the first passage 21 and the second passage 22 partially have bent portions. The bent portion widely includes a portion other than the linearly extending portion of the passage, and includes, for example, a wavy shape as shown in FIG. 9A and a zigzagged shape as shown in FIG. 9B. Further, it also includes a rectangular bent shape as shown in FIG. 9C.

With the heat exchanger core 1 according to the above-described embodiments, the passage length is extended by the bent portion provided in at least one of the overlying portions of the pair of passages 21, 22, so that the amount of heat exchange can be increased as compared with the case where the passage is straight.

Further, as shown in FIGS. 2 and 3, in the heat exchanger core 1 according to some embodiments, overlying portions of the pair of passages 21, 22 are composed of a combination of portions that are linear when viewed from a direction perpendicular to the pair of passages 21, 22.

With the heat exchanger core 1 according to the above-described embodiments, since the overlying portions of the pair of passages 21, 22 are composed of a combination of portions that are linear when viewed from a direction perpendicular to the pair of passages 21, 22, the pressure loss can be reduced as compared with the case where the passage has a bent portion.

The present invention is not limited to the embodiments described above, but includes modifications to the embodiments described above, and embodiments composed of combinations of those embodiments.

For example, in the above-described embodiments, the first fluid FL1 flowing through the first passage 21 and the second fluid FL2 flowing through the second passage 22 have a countercurrent relationship, but the inlet 21*a* of the first passage 21 and the inlet 22*a* of the second passage 22 may be set such that the first fluid FL1 and the second fluid FL2 have a parallel relationship.

Further, for example, at least one of the overlying portions of the pair of passages may partially have a twisted portion. The twisted portion is a portion whose surface includes a curved and twisted shape, and includes, for example, a spirally twisted shape.

Further, the structure in which the pair of adjacent passages are folded on top of one another while being adjacent is not limited to those that can be represented in the same cross-section, and includes those that cannot be represented in the same cross-section. For example, the structure folded in a three-dimensional space is also included.

The contents described in the above embodiments would be understood as follows, for instance.

(1) A heat exchanger core (1) according to an aspect includes a core (2) formed such that a pair of adjacent passages (21, 22) are folded on top of one another while being adjacent. At least one passage (21 (22)) of the pair of adjacent passages (21, 22) has a pair of adjacent passage portions (211, 212 (221, 222)) between which the other passage (22 (21)) is not interposed in a direction in which the passages (21 (22)) lie on top of one another. The core (2) has a heat insulation layer (23) between the pair of passage portions (211, 212).

With this configuration, the heat insulation layer (23 (24)) disposed between the pair of passage portions (211, 212 (221, 222)) reduces heat loss due to heat exchange between a fluid (first fluid (FL1) (second fluid (FL2))) flowing in the upstream portion (211 (221)) and a fluid flowing in the downstream portion (212 (222)) (between the same fluids) of the pair of passage portions (211, 212 (221, 222)). Thus, it is possible to improve the heat exchange efficiency of the heat exchanger core (1).

(2) The heat exchanger core (1) according to another aspect is the heat exchanger core 1 as defined in (1), in which at least one of overlying portions of the pair of passages partially has a bent portion.

With this configuration, the passage length is extended by the bent portion provided in at least one of the overlying portions of the pair of passages, so that the amount of heat exchange can be increased as compared with the case where the passage is straight.

(3) The heat exchanger core (1) according to another aspect is the heat exchanger core 1 as defined in (1), in which overlying portions of the pair of passages are composed of a combination of portions that are linear when viewed from a direction perpendicular to the pair of passages.

With this configuration, since the overlying portions of the pair of passages are composed of a combination of portions that are linear when viewed from a direction perpendicular to the pair of passages, the pressure loss can be reduced as compared with the case where the passage has a bent portion.

(4) The heat exchanger core (1) according to another aspect is the heat exchanger core 1 as defined in any one of (1) to (3), in which the heat insulation layer (23 (24)) is a void (231).

With this configuration, the void (231) disposed between the pair of passage portions (211, 212 (221, 222)) reduces heat loss due to heat exchange between a fluid (first fluid (FL1) (second fluid (FL2))) flowing in the upstream portion (211 (221)) and a fluid (first fluid (FL1) (second fluid (FL2))) flowing in the downstream portion (212 (222)) (between the same fluids) of the pair of passage portions. Thus, it is possible to improve the heat exchange efficiency of the heat exchanger core (1).

(5) The heat exchanger core (1) according to another aspect is the heat exchanger core 1 as defined in (4), in which the void is closed.

With this configuration, since the void is closed, the void can be in vacuum or can be filled with a gas.

(6) The heat exchanger core (1) according to another aspect is the heat exchanger core 1 as defined in any one of (1) to (4), in which the heat insulation layer is at least partially open.

With this configuration, since the air in the heat insulation layer can be replaced, the heat insulation effect can be improved.

(7) The heat exchanger core 1 according to still another aspect is the heat exchanger core 1 as defined in (4), having a strut portion (232) at least at an end of the void (231) for supporting the void (231).

With this configuration, since the strut portion (232) supports the void (231) at least at the end portion of the void, it is possible to suppress a decrease in the strength of the core (2) having the void (231).

(8) The heat exchanger core 1 according to still another aspect is the heat exchanger core 1 as defined in (7), in which the strut portion (232) has a wire mesh-like three-dimensional lattice structure.

With this configuration, it is possible to suppress a decrease in the strength of the core (2) while suppressing heat conduction by the strut portion (232).

(9) The heat exchanger core (1) according to still another aspect is the heat exchanger core 1 as defined in any one of (1) to (8), having a partition wall (214 (224)) dividing at least one of the first passage (21) or the second passage (22) into a plurality of divided passages (213 (223)).

With this configuration, the slower flow velocity of the fluid flowing through the divided passages (213 (224)) improves the heat exchange performance.

REFERENCE SIGNS LIST

1, 1A, 1B Heat exchanger core
2, 2A, 2B Core
2*a*, 2*a*1, 2*a*2 Side surface
21 First passage
21*a* Inlet
21*b* Outlet
211 Passage portion (Upstream portion)
212 Passage portion (Downstream portion)
213 Divided passage
214 Partition wall
22 Second passage
22*a* Inlet
22*b* Outlet
221 Passage portion (Upstream portion)
222 Passage portion (Downstream portion)
223 Divided passage
224 Partition wall
23 Heat insulation layer
231, 231A, 231B Void
232 Strut portion
24 Heat insulation layer
241 Void
FL1 First fluid
FL2 Second fluid.

The invention claimed is:

1. A heat exchanger core, comprising a core formed such that a pair of adjacent passages are folded on top of one another while being adjacent, wherein at least one passage of the pair of adjacent passages has a pair of adjacent passage portions between which the other passage is not interposed in a direction in which the passages lie on top of one another, wherein the core has a heat insulation layer between the pair of adjacent passage portions, wherein overlying portions of the pair of adjacent passages are composed of a combination of portions that are linear when viewed from a direction perpendicular to the pair of adjacent passages, wherein the heat insulation layer is a void, wherein the core has a strut portion at least at an end of the void for supporting the void, and wherein the strut portion is made of the same metal or resin material as the core.

2. The heat exchanger core according to claim 1, wherein at least one of overlying portions of the pair of adjacent passages partially has a bent portion.

3. The heat exchanger core according to claim 1, wherein the void is closed.

4. The heat exchanger core according to claim 1, wherein the strut portion has a wire mesh-like three-dimensional lattice structure.

5. The heat exchanger core according to claim 1, comprising a partition wall dividing at least one of the pair of adjacent passages into a plurality of divided passages.

* * * * *